United States Patent [19]

Bourlet

[11] 3,974,739

[45] Aug. 17, 1976

[54] BELT AMMUNITION BOX FOR PORTABLE WEAPONS

[75] Inventor: Maurice V. Bourlet, Liege, Belgium

[73] Assignee: Fabrique Nationale Herstal S.A., Herstal-lez-Liege, Belgium

[22] Filed: Aug. 13, 1974

[21] Appl. No.: 497,074

[30] Foreign Application Priority Data

Sept. 28, 1973 Belgium ..... 805425

[52] U.S. Cl. ..... 89/34; 206/3

[51] Int. Cl.[2] ..... F41D 9/00

[58] Field of Search ..... 89/33 R, 33 BB, 33 BC, 89/33 L, 33 LA, 34, 35 R, 35 A; 206/3

[56] References Cited

UNITED STATES PATENTS

| | | | |
|---|---|---|---|
| 1,772,826 | 8/1930 | Coupland | 89/33 BB |
| 2,401,762 | 6/1946 | Irasek | 89/34 |
| 3,293,986 | 12/1966 | Stoner | 89/34 |

FOREIGN PATENTS OR APPLICATIONS

| | | | |
|---|---|---|---|
| 1,934,144 | 2/1971 | Germany | 89/34 |

*Primary Examiner*—Stephen C. Bentley
*Attorney, Agent, or Firm*—Bacon & Thomas

[57] ABSTRACT

The invention pertains to a belt ammunition box for portable weapons of overall prismatic shape, characterized by the fact that its front face consists of a tightly closing door which, together with a cut away portion of the upper surface of the box, bounds a passage for the belt of cartridges, aforesaid passage being, at the start, closed by a closing element made up of a platelet and a dummy link associated with one of the ends of aforesaid belt.

7 Claims, 6 Drawing Figures

BELT AMMUNITION BOX FOR PORTABLE WEAPONS

This invention is concerned with improvements and with novel arrangements which, by their coexistence considerably improve the efficiency, the safety and the comfort of the belt ammunition box. Consequently, the safety and the efficiency of the weapon itself are also increased.

These improvements and novel arrangements are mainly as follows: the box is of general prismatic shape, so that it can be stacked, thus facilitating the transport in cases. The box shall preferably be entirely or partially made of some transparent or translucid material, so as to permit a permanent visual check of the ammunition belt, and more particularly of the number of cartridges remaining within it. This advantage is important from a practical and a psychological point of view. On its frontal surface, the box consists of a tightly closing door of which one edge cooperates with a cut away portion provided in the adjacent edge of the box so as to bound the outlet passage for the belt, the first element of which is conditioned to form simultaneously a temporary closing element for aforesaid passage and a gripping element in order comfortably to bring the belt of cartridges in engagement with the firing mechanism of the weapon. The three other edges of the box which are adjacent to the door are extended by flared ledges in order to facilitate the entering of the belt in the box. According to the invention, the box is also conditioned so as to be able to be hooked unto the weapon with one hand, to be able to be hooked unto the waistbelt by the individual transport and thus to be able to be solidly attached, by stacking, to a single handling element. An example of these last means is the subject of a Belgian patent application NOPV 53098, filed by the same applicant on the same date as the present one. Merely as an example, without the slightest intent at limitation, a form of embodiment is described hereinafter in detail, with reference to the appended drawings in which:

Figure 1:
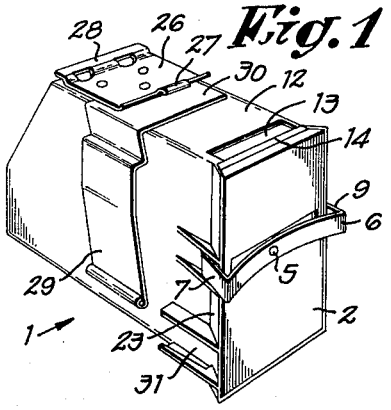
FIG. 1 shows a perspective view of the magazine improved according to the invention, in closed condition.

In this form of embodiment, the box 1 is of prismatic shape and preferably is made, entirely or partially, of some strong and transparent material such as Plastiglas, for instance.

The frontal face of aforesaid box consists of a door 2 provided peripherally, on its inner surface, with some sealing material 3, for instance a coating of foam of synthetic material. On its inner surface, aforesaid door is provided with a curved elastic blade 4 intended to prevent the inadvertent re-entry of the belt in the box.

On the rear surface of door 2, fixed in its center by means of a rivet 5, there is an elastic blade 6. The latter is of an overall U shape, one of the side branches 7 of which is applied against a shaft 8, thus forming a hinge, whereas the other side branch 9 has its outer edge 10 bent over so as to be able to press against a protrusion 11 of the box, thus assuring a sealed closing of the box by means of aforesaid door 2. This closing system might be made of some plastic material and be an integral part of door 2 and of box 1.

The edge of upper surface 12 of the box, adjacent to aforesaid door 2 when in closed position, is provided with a cut away part 13 which, by cooperating with adjacent edge 14 of the door, bounds a passage opening for the belt, and respectively for the cartridges carried by the latter.

Figure 5:
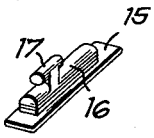
FIG. 5 shows a perspective view of the gripping element of the end of the cartridge belt.
Figure 2:
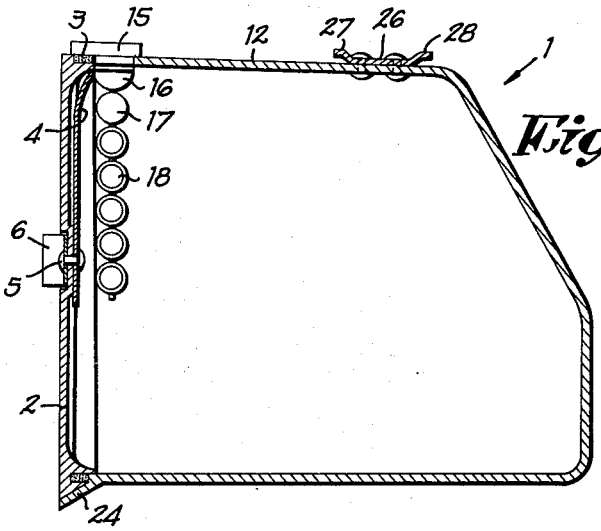
FIG. 2 shows the magazine in longitudinal section.
Figure 3:
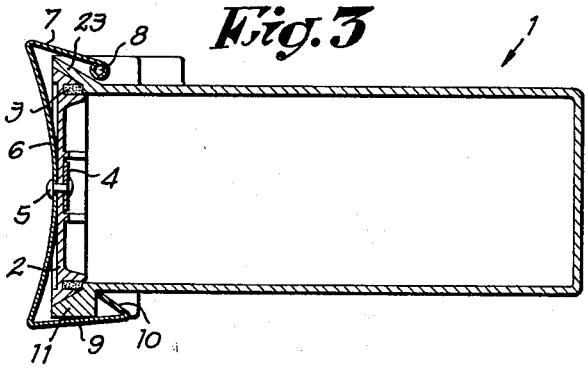
FIG. 3 shows a horizontal section thereof.
Figure 4:
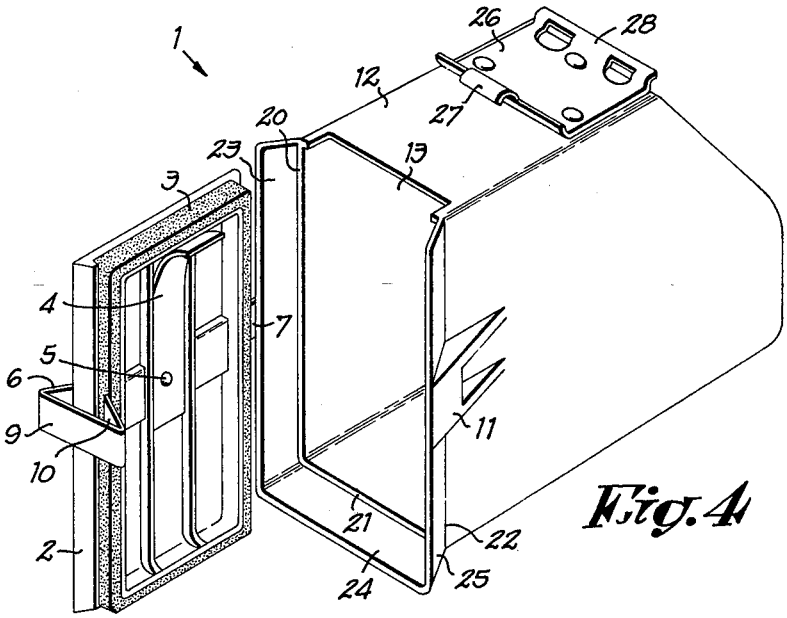
FIG. 4 shows a perspective view of the magazine in open condition.
Figure 6:
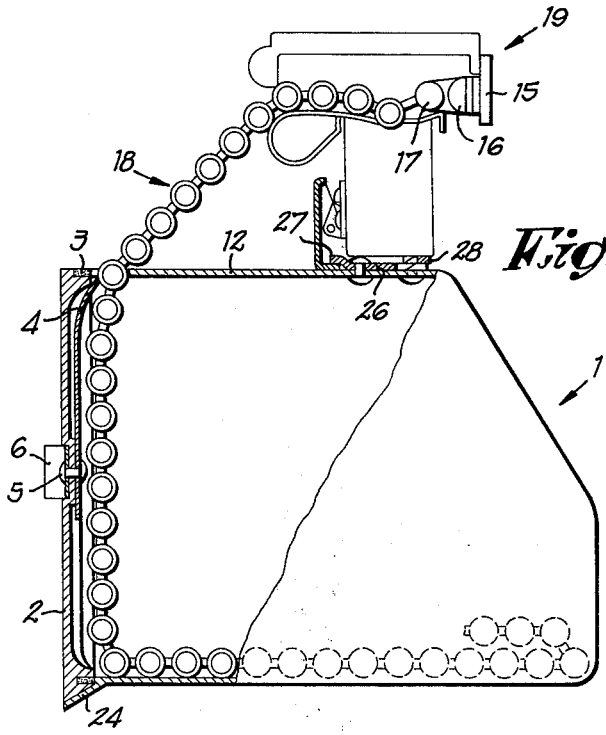
FIG. 6 is similar to FIG. 2, the cartridge belt being schematically shown in engagement with the weapon.

This arrangement is extremely comfortable both for entering the cartridge belt into box 1 and for placing the cartridge belt in its starting position. For this purpose, and complementarily to this arrangement, the cartridge belt is provided with a first link of very particular shape so that, in a form of embodiment shown in FIG. 5, it consists of a platelet 15, one face of which carries a semi-cylindrical ridge 16, itself surmounted in its center by a dummy link 17. The latter is hooked unto the end of the cartridge belt 18. The length and the width of the semi-cylindrical ridge 16 are such that it can freely enter aforesaid passage 13 in box 1, whereas the width and the length of platelet 15 are larger respectively than the length and the width of aforesaid passage 13. As a result thereof, when the belt of cartridges is fitted in the box, aforesaid passage 13 is obstructed by aforesaid platelet 15, whereas however, in order to bring the belt of cartridges in position to feed the weapon, in the present case schematically sketched as 19, aforesaid platelet 15 will form gripping element, thus greatly facilitating the charging of the weapon. Moreover, aforesaid platelet 15, conditioned in this manner, will systematically prevent the inadvertent return of the belt towards the box. In view of facilitating the entry of the belt in the box and in cooperation with aforesaid cut away portion 13, the three other edges, 20-21-22, are extended by flared walls, respectively 23-24-25.

In view of the attachment of the box unto the weapon with only one hand, a platelet 26 is provided on the upper surface 12 of the box and of which two parallel edges are bent over so as to form hooking on ledges 27-28.

Finally, in order to be able to hook the box unto the waistbelt, it is provided with a side strip 29, in the present case L shaped, one of the branches 30 of which is attached to the upper surface 12 of the box.

Therefore, at the beginning, when the belt of cartridges 18 is entirely fitted into box 1, passage 13 is closed by platelet 15 which may extend on both sides beyond upper surface 12 of aforesaid box.

The entering of aforesaid belt of cartridges into aforesaid box is facilitated by the freeing of the front face of the box, door 2 being open. The hooking on of aforesaid platelet 15 is facilitated by cut away portion 13, the opening of door 2 and the presence of the flared walls 23-24-25.

In order eventually to recover closing element 15-17, a seating 31 is provided on one of the outer sides of the box, into which the closing element can be entered so as to be able to be used to equip a new belt of cartridges.

The various characteristics described above may of course be altered in shape and dimensions in accordance with the application under consideration.

What I claim is:

1. A belt ammunition box for portable weapons of overall prismatic shape, characterized by the fact that its front face comprises of a tightly closed door which, together with a cut away portion of the upper surface of the box, bounds a passage for the belt of cartridges, aforesaid passage being, at the start, closed by a closing element made up of a platelet, a rigid member carried by one face of said platelet and fitting within said passage, and a dummy link carried by said rigid member for hooking onto one of the ends of aforesaid belt, said platelet having a width and a length which are greater, respectively, than the width and the length of the cut away portion in the top wall of the box and providing a gripping element for bringing the belt of cartridges in armed position.

2. Box according to claim 1, characterized by the fact that the two side edges and the lower edge of the open side of the box are extended by flared walls.

3. Box according to claim 1, characterized by the fact that the door is fitted with a sealing gasket extending around its periphery and with an elastic closure fastener engagable with a wall of the box for securing the door in sealed, closed position.

4. Box according to claim 1, characterized by the fact that the inside wall of the door is provided with a curved elastic blade having one end terminating adjacent said passage when the door is in the closed position for the purpose of preventing the inadvertent reentry of the belt in the box.

5. Box according claim 1 characterized by the fact that it is made, at least partially, out of some resistant and transparent material.

6. Box according to claim 1, characterized by the fact that it is fitted on its top surface with a platelet having two parallel edges bent away so as to form an attaching element allowing the box to be fixed to the weapon.

7. Box according to claim 1, characterized by the fact that said box is fitted with a side strip permitting it to be hooked unto the waistbelt.

* * * * *